US006802154B1

(12) United States Patent
Holt et al.

(10) Patent No.: US 6,802,154 B1
(45) Date of Patent: Oct. 12, 2004

(54) AUTOMATIC SLIDING DOOR OPENING AND CLOSING SYSTEM WITH A RELEASING MECHANISM FOR FIXABLY AND RELEASABLY ATTACHING A VEHICLE DOOR TO A BELT DRIVE SYSTEM

(75) Inventors: Larry Holt, Uxbridge (CA); Sean Clare, Toronto (CA); Douglas G. Broadhead, Brampton (CA)

(73) Assignee: Multimatic, Inc., Markham (CA)

( * ) Notice: Subject to any disclaimer, the term of this patent is extended or adjusted under 35 U.S.C. 154(b) by 0 days.

(21) Appl. No.: 09/599,837

(22) Filed: Jun. 23, 2000

(51) Int. Cl.[7] ..... E05F 15/10
(52) U.S. Cl. ..... 49/26; 49/139; 49/360
(58) Field of Search ..... 49/26, 28, 209, 49/211, 213, 216, 360, 139

(56) References Cited

U.S. PATENT DOCUMENTS

| | | | | | |
|---|---|---|---|---|---|
| 573,489 | A | * | 12/1896 | Shull | 49/213 |
| 2,225,003 | A | * | 12/1940 | Gorman | 49/28 |
| 3,045,164 | A | * | 7/1962 | Russell | 318/266 |
| 3,353,298 | A | * | 11/1967 | Pfender et al. | 49/43 |
| 3,630,094 | A | * | 12/1971 | Carli | 74/89.21 |
| 4,311,225 | A | * | 1/1982 | Tsubaki et al. | 192/142 |
| 4,386,398 | A | * | 5/1983 | Matsuoka et al. | 700/90 |
| 4,502,375 | A | * | 3/1985 | Hignite et al. | 454/56 |
| 4,520,684 | A | * | 6/1985 | Meyer et al. | 74/89.21 |
| 4,628,636 | A | * | 12/1986 | Folger | 49/199 |
| 4,716,630 | A | * | 1/1988 | Skyba | 24/134 R |
| 4,850,140 | A | * | 7/1989 | Compeau et al. | 49/347 |
| 4,885,872 | A | * | 12/1989 | Chang et al. | 49/362 |
| 4,956,938 | A | * | 9/1990 | Dement | 49/28 |
| 4,956,939 | A | * | 9/1990 | Kuhlman | 49/347 |
| 5,069,000 | A | * | 12/1991 | Zuckerman | 49/28 |
| 5,083,397 | A | * | 1/1992 | Koura | 49/28 |
| 5,613,321 | A | * | 3/1997 | Rizkovsky | 49/139 |
| 5,758,453 | A | * | 6/1998 | Inage | 49/118 |
| 5,794,381 | A | * | 8/1998 | Rizkovsky | 49/139 |
| 5,833,301 | A | * | 11/1998 | Watanabe et al. | 296/155 |
| 6,036,257 | A | * | 3/2000 | Manuel | 296/155 |
| 6,199,322 | B1 | * | 3/2001 | Itami et al. | 49/139 |

* cited by examiner

*Primary Examiner*—Gregory J. Strimbu
(74) *Attorney, Agent, or Firm*—Kramer & Amado, P.C.; Gordon J. Zimmerman, Esq.

(57) ABSTRACT

An automatic sliding door opening and closing system comprises a continuous, powered belted drive system and a clamp arrangement capable of fixably and releasably attaching the automotive sliding door to the belt drive system so as to be automatically driven along a predetermined path and capable of releasing the belt drive system under predetermined conditions. The powered belt drive system is located so as to be combined with one of the door's standard sliding door hinge systems. The clamp arrangement is a rotary device biased into a pinching engagement on the belt of the belt drive system via a cam and spring arrangement.

9 Claims, 4 Drawing Sheets

AUTOMATIC SLIDING DOOR OPENING AND CLOSING SYSTEM WITH A RELEASING MECHANISM FOR FIXABLY AND RELEASABLY ATTACHING A VEHICLE DOOR TO A BELT DRIVE SYSTEM

FIELD OF THE INVENTION

This invention relates to the field of automative door opening and closing systems, and particularly to an integrated system of components that transport an automotive sliding door through its range of motion while providing adequate user safety.

DESCRIPTION OF THE PRIOR ART

Sliding doors are widely used on the class of vehicles generally referred to as vans. Vans typically have normal swinging front doors and one or more sliding side doors. These types of sliding doors translate out of the side opening in the vehicle to facilitate ingress/egress rather than rotating, as is the more common motion of automotive closures. The most common and widely used sliding door system consists of three body-mounted tracks (3) and three corresponding door-mounted hinge/roller assemblies (15), as illustrated in FIGS. 4 and 5. The body mounted tracks are normally located at the roof, floor and mid-positions on the side of the vehicle with the roof-position and floor-position components being arranged in-line with the door opening and the mid-position (centre) track located rearward of the side opening. It is normal practice to utilize the lower and centre tracks to carry the vertical weight of the door. The travel path of the door is therefore defined by the track shape and articulation of the hinge/roller assemblies.

Power closing and opening of automotive sliding door systems has become a popular feature. The present state of the art involves use of electrically driven systems that power the door through the range of motion defined by the conventional hinge/roller/track system. The majority of such systems act on the centre hinge/roller/track assembly although some are integrated with the lower hinge/roller/track assembly. Both belt and cable drives are utilized. In addition to powering the door though its range of motion, these systems must provide protection against injury when obstructed during powered movement and normal manual operation capability when required.

Current state of the art sliding door powered opening and closing systems use sophisticated electronic hardware and software algorithms to achieve acceptable levels of obstruction detection. The most common method of protection utilizes drive motor electrical current sensing to indicate when a person or other object is in the path of the closing door. The associated software algorithms are becoming increasingly sophisticated to coordinate hold-open latches, power pull-in latches, and other additional features. A major drawback of all existing art is that it does not provide manual operation performance equal to passive systems since some additional power related components are always engaged even when the sliding door is manually operated. Clutch disengagement upstream of the cable or belt drive is the most common manual operation mode, which adds significant operating load due to the associated friction with such mechanisms and operations.

SUMMARY OF THE INVENTION

Accordingly, it would be advantageous to create a sliding door opening and closing system which does not suffer from the drag and friction associated with engagement of power related components even when the door is in manual operation.

The present invention is targeted at reducing the complexity of automatic sliding door opening and closing systems. It specifically eliminates electronic obstruction detection by utilizing a mechanical arrangement and additionally provides uncompromised manual performance by completely decoupling the power system.

In a major aspect of the invention, an automatic sliding door opening and closing system comprises a continuous, powered belt drive system located on a vehicle body; and a clamp arrangement capable of fixably attaching a vehicle door to the belt drive system so as to be automatically driven along a predetermined path and capable of releasing under predetermined conditions.

In a further aspect, the powered belt drive system is located so as to be combined with one of a standard hinge system's three body tracks. In a further aspect, the clamp arrangement is attached directly to one of the standard door hinge/roller assemblies on the door. In a further aspect, the clamp arrangement is a rotary device biased into a pinching action on the belt via a cam and spring arrangement, and the rotary device is arranged so as to release from the belt at a predetermined force threshold. In a further aspect, the powered belt drive system incorporates two belt tensioning devices, located on opposite sides of the clamp arrangement, capable of providing the required belt slack to facilitate movement of the rotary clamping device into a pinching engagement with the belt.

Further aspects of the invention will become apparent from the following description.

DETAILED DESCRIPTION OF THE INVENTION

Figure 1:
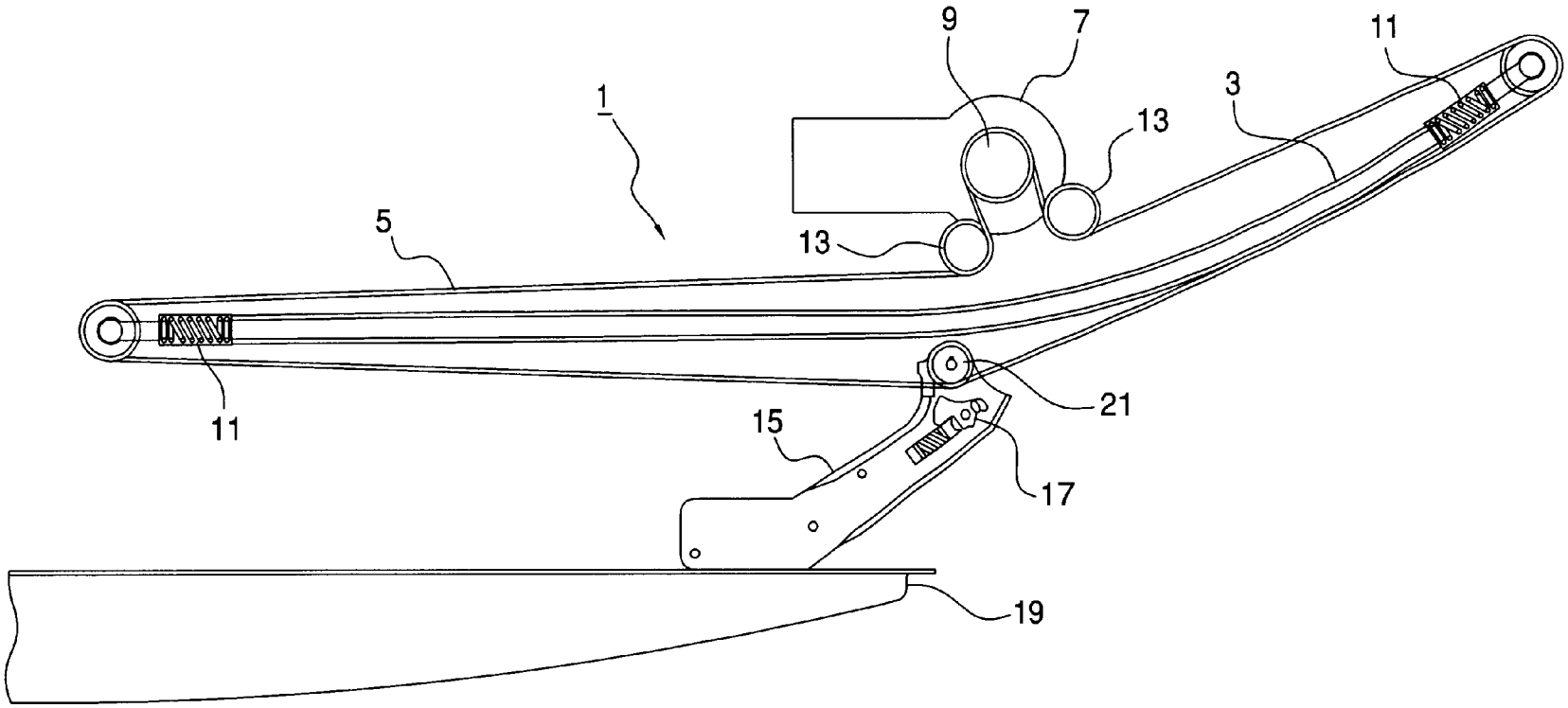
FIG. 1 is a plan view of the complete automatic sliding door opening and closing system of the invention.
Figure 2:
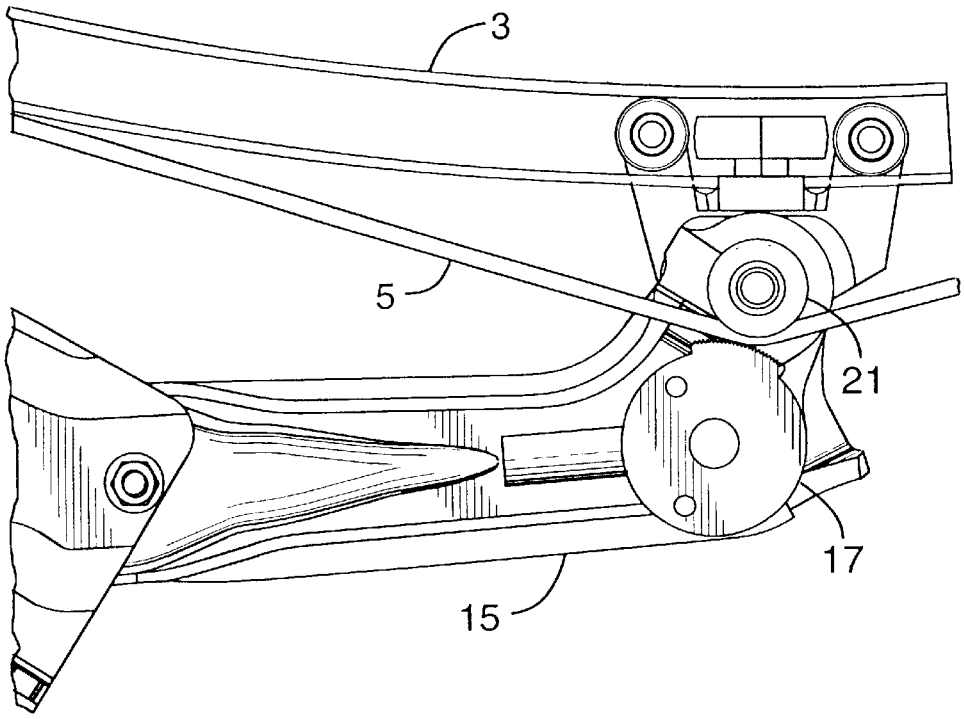
FIG. 2 is a plan view of the hinge/roller assembly and clamp of the invention.
Figure 4:
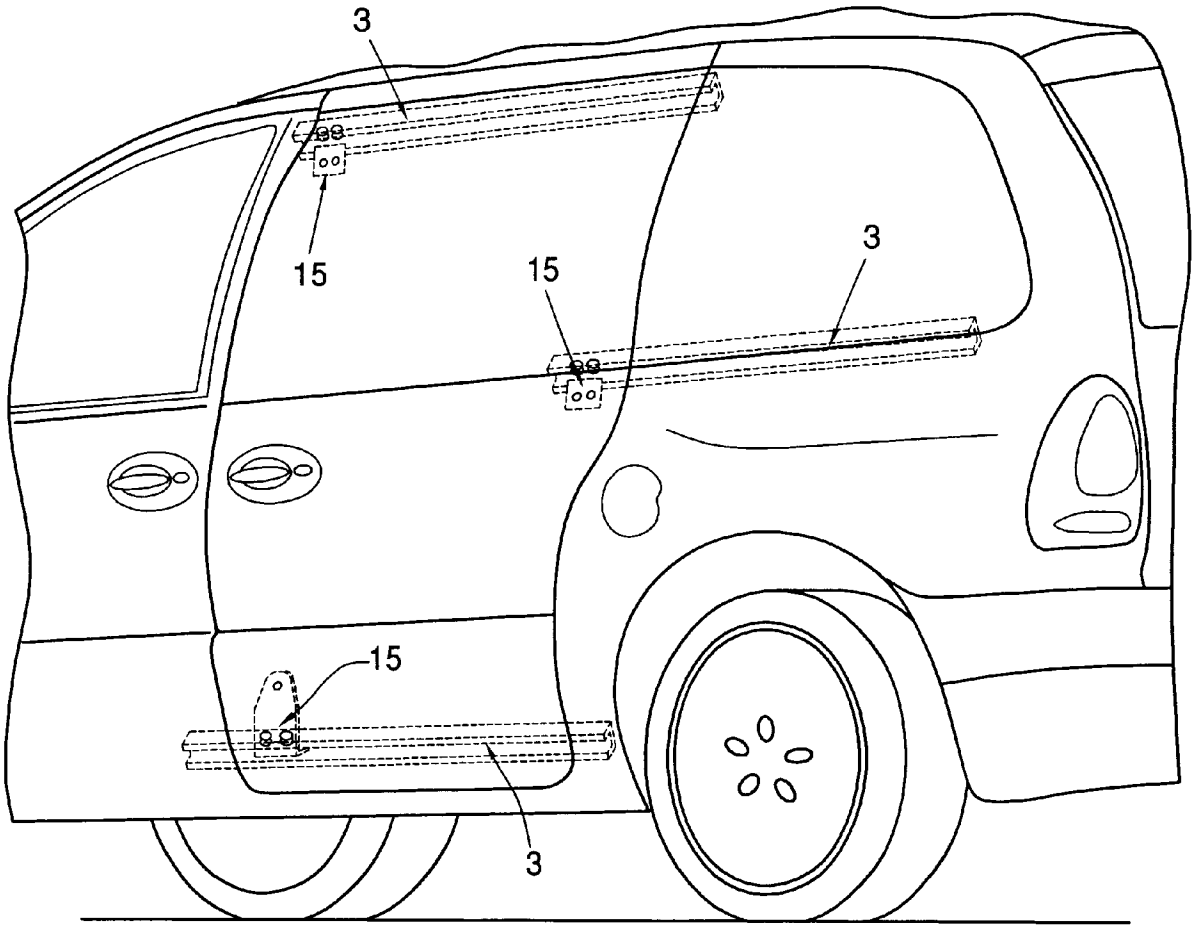
FIG.4 Prior Art
FIG. 4 is a perspective view illustrating a typical automotive sliding door system in the closed configuration.
Figure 5:
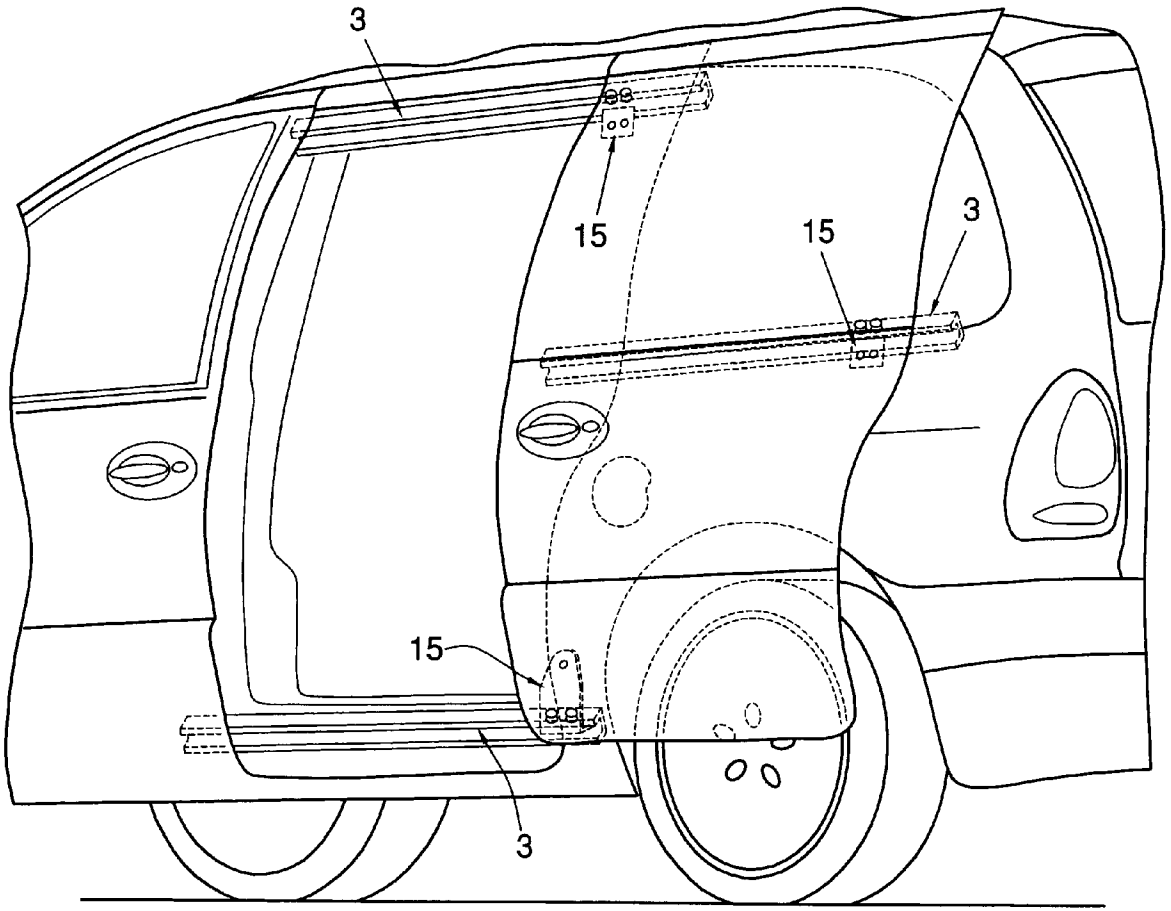
FIG.5 Prior Art
FIG. 5 is a perspective view illustrating a typical automotive sliding door system in the open configuration.

In a preferred embodiment of the invention, referring to FIG. 1, a continuous belt drive system (1) is located so as to be combined with one of the three body mounted tracks (3) (see also FIGS. 2, 4 and 5) utilized in conventional automotive sliding door systems. This drive system comprises a continuous-loop belt (5), electrical motor (7) and drive pulley (9), two belt-tensioning devices (11) and a number of idlers (13) used for belt routing. Idlers are typically unpowered, rotatable pulleys. The belt drive system is configured so that the belt (5) rides over a roller (21) and is exposed on the outer side of the track (3) so that it is adjacent to the corresponding door mounted hinge/roller assembly (15). The belt drive system is configured to be driven by the electrical motor (7) in both directions.

A clamp (17), mounted on the hinge/roller assembly (15), interacts with the track (3) containing the belt drive system (1). This clamp is configured so that it can be biased to pinch the belt into a clamping condition against the roller (21) so that when the belt is driven by the motor (7) the door (19) is drawn along the path defined by the hinge/roller/track configuration. The clamp (17) is biased so that it is held in the pinch condition until a predetermined belt load is exceeded, at which point it moves out of the pinch condition and releases the door (19) from the belt drive system (1). When the clamp (17) is in the non-pinch condition, the door (19) can be moved along the path defined by the hinge/roller/track configuration with no interaction with the belt drive system (1). A power actuator (not shown) is configured to move the clamp (17) back into the pinch condition with the belt (5). The belt drive system has the capability to pull the door into the first position of the main door latch (i.e. the secondary latched position) and a power pull-in latch (not shown) is used to achieve full primary latching. An electronic control system and associated sensing transducers (not shown) are used to co-ordinate and actuate the belt drive motor (7), clamp actuator and main latch.

Figure 3:
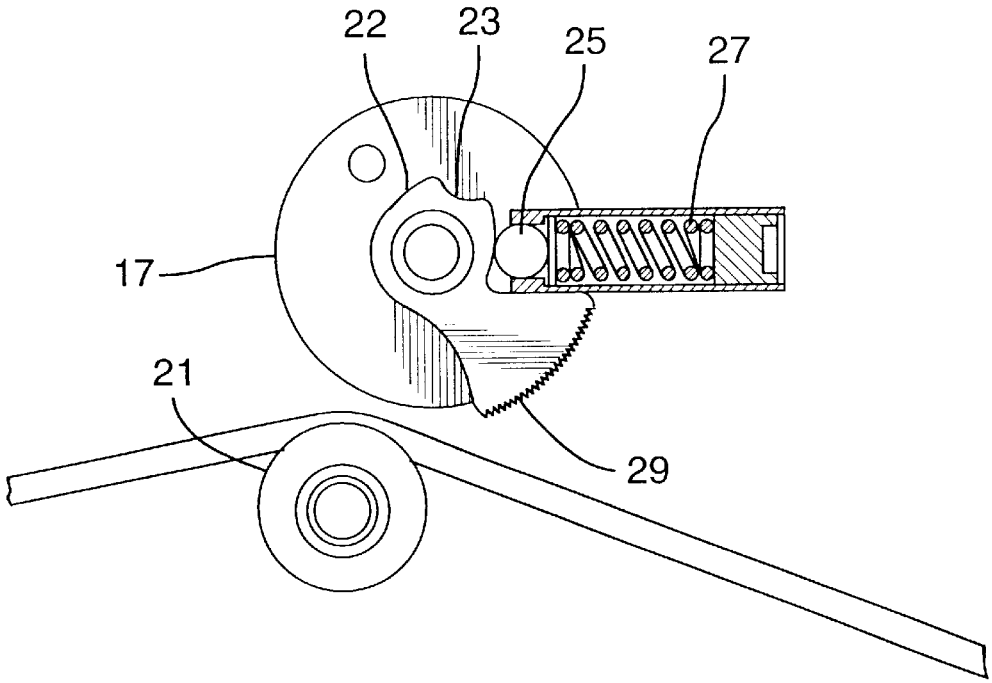
FIG. 3 is a view of the clamp arrangement of the invention in an unclamped position.

In a preferred embodiment, referring to FIG. 3, the clamp (17) comprises a rotary device which is biased into the belt pinch position via a cam (22) interacting with a bail (25) and compression spring (27). The compression spring (27) pushes the ball (25) into a cam pocket (23), integral with the rotary clamp which maintains the device in the pinch position. The surface of the clamp (17) that engages the belt (5) in the pinch position incorporates serrations (29) which enhance the pinching action and minimize the possibility of slippage between the belt (5) and clamp (17). The rotary clamp (17) disengages from the belt (5) when an obstruction in the path of the door (19) causes the belt load to exceed a predetermined threshold. The threshold load is defined by the cam profile, spring force and spring pre-compression. A power actuator is attached to the hinge/roller assembly which rotates the clamp (17) back into the pinch condition with the belt (5) upon receiving an electromagnetically-communicated command, such as from a push button located within the van, or from a key fob button. The belt drive system must be capable of providing the necessary belt slack to allow the rotary clamp (17) to fully rotate to the pinch position. This belt slack is provided by two belt tensioning devices (11), located on opposite sides of the clamp arrangement, which are capable of providing belt slack when the system is not driving the door but can lock when required to transmit belt load. An additional function of these tensioners is to compensate for belt stretch as the system is subjected to prolonged usage. The rotary clamp system may also be utilized in conjunction with a power pull-in latch, electronic control system and associated sensing transducers.

The clamp system is designed to disengage when the door reaches its fully open or fully closed positions by reacting to the overload condition in the same way as in the case of an obstruction. The system remains in a manual mode until it receives a signal to operate automatically. This signal initially causes the main latch to disengage (when in the closed position) followed by the autuator engaging the belt clamp into the pinch position and finally by running the belt drive motor until either an obstruction or full motion causes the clamp to release.

What is claimed is:

1. An automatic sliding door opening and closing system, comprising:

(a) a continuous, powered belt drive system having a driven belt; and (b) a clamp arrangement attached to a door and releasably clamping the belt, such that the door is automatically driven along a predetermined path by the belt and the clamp releases the belt in response to an obstruction in the predetermined path, wherein the clamp arrangement is releasably clamped to the belt at any position along the predetermined path of the door between an open and a closed position of the door.

2. The automatic sliding door opening and closing system of claim 1, further including at least one track and wherein the powered belt drive system is located so as to be combined with the at least one track.

3. The automatic sliding door opening and closing system of claim 2, wherein the door includes a roller assembly and the clamp arrangement is attached to the roller assembly of the door.

4. An automatic sliding door opening and closing system, comprising:

(a) a continuous, powered belt drive system having a driven belt; and (b) a clamp arrangement attached to a door and releasably attached to the belt, such that the door is automatically driven along a predetermined path by the belt and the clamp arrangement is capable of releasing the belt in response to an obstruction in the predetermined path, wherein the clamp arrangement is a rotary device biased into pinching engagement on the belt via a cam and spring arrangement.

5. The automatic sliding door opening and closing system of claim 4, wherein the powered belt drive system incorporates two belt tensioning devices located on opposite sides of the clamp arrangement.

6. An automatic sliding door opening and closing system, comprising:

(a) a continuous, powered belt drive system having a driven belt;

(b) a clamp arrangement attached to a door and releasably attached to the belt, such that the door is automatically driven along a predetermine path by the belt and the clamp arrangement is capable of releasing the belt in response to an obstruction in the predetermined path; and (c) at least one track, wherein the powered belt drive system is located so as to be combined with the track and the clamp arrangement is a rotary device biased into pinching engagement on the belt via a cam and spring arrangement.

7. The automatic sliding door opening and closing system of claim 6, wherein the powered belt drive system incorporates two belt tensioning devices located on opposite sides of the clamp arrangement.

8. An automatic sliding door opening and closing system, comprising:

(a) a continuous, powered belt drive system having a driven belt;

(b) a clamp arrangement attached to a door and releasably attached to the belt, such that the door is automatically driven along a predetermined path by the belt and the clamp arrangement is capable of releasing the belt in response to an obstruction in the predetermined path; and (c) at least one track, wherein the powered belt drive system is located so as to be combined with the track, the door includes a roller assembly and the clamp arrangement is attached to the roller assembly of the door and the clamp arrangement is a rotary device biased into pinching engagement on the belt via a cam and spring arrangement.

9. The automatic sliding door opening and closing system of claim 8, wherein the powered belt drive system incorporates two belt tensioning devices located on opposite sides of the clamp arrangement.

* * * * *

UNITED STATES PATENT AND TRADEMARK OFFICE

CERTIFICATE OF CORRECTION

PATENT NO. : 6,802,154 B1
DATED : October 12, 2004
INVENTOR(S) : Larry Holt et al.

It is certified that error appears in the above-identified patent and that said Letters Patent is hereby corrected as shown below:

Column 4,
Line 36, delete “predetermine” and insert -- predetermined --.

Signed and Sealed this

Fourteenth Day of December, 2004

JON W. DUDAS
*Director of the United States Patent and Trademark Office*